US010603811B2

(12) United States Patent
Shimizu et al.

(10) Patent No.: US 10,603,811 B2
(45) Date of Patent: Mar. 31, 2020

(54) STAPLER

(71) Applicant: MAX CO., LTD., Tokyo (JP)

(72) Inventors: Toshio Shimizu, Tokyo (JP); Futoshi Kameda, Tokyo (JP); Shinpei Sugihara, Tokyo (JP)

(73) Assignee: MAX CO., LTD., Tokyo (JP)

( * ) Notice: Subject to any disclaimer, the term of this patent is extended or adjusted under 35 U.S.C. 154(b) by 339 days.

(21) Appl. No.: 15/786,662

(22) Filed: Oct. 18, 2017

(65) Prior Publication Data

US 2018/0117788 A1 May 3, 2018

(30) Foreign Application Priority Data

Oct. 31, 2016 (JP) ..... 2016-213884

(51) Int. Cl.

| | |
|---|---|
| ***B27F 7/36*** | (2006.01) |
| ***G03G 15/00*** | (2006.01) |
| ***B27F 7/21*** | (2006.01) |
| *B27F 7/38* | (2006.01) |

(52) U.S. Cl.

CPC ..... *B27F 7/36* (2013.01); *B27F 7/21* (2013.01); *G03G 15/6541* (2013.01); *B27F 7/38* (2013.01); *B65H 2403/51* (2013.01); *G03G 15/6544* (2013.01)

(58) Field of Classification Search

CPC ..... B27F 7/36; B27F 7/21; B27F 7/38; G03G 15/6541; G03G 15/6544; B65H 2403/51

USPC ..... 227/81–82, 107–156

See application file for complete search history.

(56) References Cited

U.S. PATENT DOCUMENTS

| | | | | |
|---|---|---|---|---|
| 3,423,002 A * | 1/1969 | Hatazaki | B25C 5/0228 | 227/131 |
| 3,708,095 A * | 1/1973 | Briggs, Jr. | B25C 1/005 | 227/126 |
| 4,523,707 A * | 6/1985 | Blake, III | A61B 17/0684 | 227/19 |
| 4,542,844 A * | 9/1985 | Olesen | B25C 5/0228 | 227/7 |
| 4,574,992 A * | 3/1986 | Holman | B25C 5/1665 | 227/130 |

(Continued)

FOREIGN PATENT DOCUMENTS

| | | |
|---|---|---|
| JP | 2004-209561 A | 7/2004 |
| JP | 2006-26860 A | 2/2006 |

*Primary Examiner* — Robert F Long

(74) *Attorney, Agent, or Firm* — Rothwell, Figg, Ernst & Manbeck, P.C.

(57) ABSTRACT

The staple receiving portion includes a clamping portion exposed to the paper clamping portion and configured to clamp the sheets of paper, and a staple guide portion provided on an end portion of the clamping portion at a side thereof, on which the staple striking portion is located, and configured to guide the staple struck by the staple striking portion. The clamping portion is made configured of a resin material. The staple guide portion includes a staple leg support member provided on a side of the clamping portion opposite to a side thereof, on which the sheets of paper are clamped, and configured to support the staple legs of the staple struck by the staple striking portion, and a guide member provided to oppose the staple leg support member, the staple leg support member and the guide member are made configured of a metal material.

3 Claims, 5 Drawing Sheets

(56) References Cited

U.S. PATENT DOCUMENTS 4,583,276 A * 4/1986 Olesen ..... B25C 5/045 29/432.1
4,821,939 A * 4/1989 Green ..... A61B 17/072 227/19
4,969,591 A * 11/1990 Richards ..... A61B 17/0644 227/132
5,273,199 A * 12/1993 Logtens ..... B25C 5/1686 227/120
5,692,667 A * 12/1997 Chi ..... B25C 5/025 227/134
6,257,477 B1 * 7/2001 Strålåt ..... B25C 5/0207 227/107
6,705,504 B1 * 3/2004 Kanai ..... B27F 7/19 227/114
6,918,527 B2 * 7/2005 Hakozaki ..... B27F 7/38 227/120
7,021,512 B1 * 4/2006 Nakamura ..... B25C 5/00 227/120
7,228,999 B2 * 6/2007 Oide ..... B27F 7/19 227/119
7,306,131 B2 * 12/2007 Bargo ..... B25C 5/02 227/110
7,510,106 B2 * 3/2009 Manabe ..... B25C 5/02 227/107
D593,824 S * 6/2009 Yagi ..... D8/49
7,992,755 B2 * 8/2011 Kameda ..... B27F 7/38 227/120
2004/0060959 A1 * 4/2004 Ura ..... B25C 5/0228 227/155
2005/0017048 A1 * 1/2005 Yoshie ..... B27F 7/006 227/111
2006/0163308 A1 * 7/2006 Kitamura ..... B27F 7/21 227/82
2006/0231583 A1 * 10/2006 Kumayama ..... B25C 5/0242 227/134
2006/0255087 A1 * 11/2006 Straat ..... B27F 7/38 227/82
2007/0075112 A1 * 4/2007 Porth ..... B25C 1/008 227/107
2008/0048001 A1 * 2/2008 Shor ..... B25C 5/1693 227/147
2008/0061102 A1 3/2008 Hakozaki et al.
2008/0156844 A1 * 7/2008 Braganza ..... B25C 5/06 227/109
2008/0265000 A1 * 10/2008 Jonsson ..... B27F 7/21 227/119
2009/0045238 A1 * 2/2009 Melgaard ..... B25C 5/0242 227/120
2009/0314819 A1 * 12/2009 Co ..... B25C 5/0242 227/120
2011/0049213 A1 * 3/2011 Schneider ..... B25C 5/025 227/120
2018/0361614 A1 * 12/2018 Sugihara ..... B27F 7/38
2019/0315013 A1 * 10/2019 Sugihara ..... B27F 7/21

* cited by examiner

STAPLER

CROSS-REFERENCE TO RELATED APPLICATION

This application claims priority from Japanese Patent Application No. 2016-213884 filed on Oct. 31, 2016, the entire contents of which are incorporated herein by reference.

TECHNICAL FIELD

The present invention relates to a stapler for binding a plurality of sheets of paper with a staple.

BACKGROUND

In electric staplers used in post-processing devices, a staple guide portion for guiding a staple to be struck out is provided on a staple cartridge, in which staples are received (e.g., see Japanese Patent Application Publication No. 2004-209561). As staple guide portions, a staple cartridge has been proposed, in which a staple leg support member is provided to oppose a guide member provided on a front end of the staple cartridge and referred to as a face plate or the like, and staple legs of a staple struck out from the staple cartridge is pressed against the guide member by the staple leg guide member.

For staplers on which such a staple cartridge is attached, a technique has been proposed, in which a clamping portion for clamping sheets of paper is formed by a part of a case constituting the exterior of the staple cartridge (e.g., see Japanese Patent Application Publication No. 2006-26860). The case of the staple cartridge is typically configured of a resin material. In such a conventional staple cartridge, the staple leg support member configured of a metal material is exposed on the clamping portion formed by the case configured of a resin material.

In the conventional staplers, the staple leg support portion is exposed on the clamping portion formed by the case of the staple cartridge. Since the case of the staple cartridge and the staple leg support member are separate components, a groove, a step and the like formed at a boundary between the clamping portion and the staple leg support member are exposed on the surface of the clamping portion.

Therefore, there is a possibility that during an operation of inserting sheets of paper into the paper clamping portion, the sheets of paper are caught on the groove, the step and the like and thus a poor insertion of the sheets of paper is occurred. Also, in a configuration in which the staple leg support member is not provided, the staple legs of the staple cannot be sufficiently supported during an operation of forcing the staple legs to penetrate the sheets of paper. Therefore, there is a possibility that buckling of the staple legs is occurred.

SUMMARY

Accordingly, the present invention has been made to solve the above problems, and an object thereof is to provide a stapler in which it is possible to inhibit occurrence of a poor insertion of sheets of paper and also to inhibit occurrence of buckling of staple legs.

In order to solve the above object, the present invention is a stapler, including a staple striking portion for striking a staple to penetrate sheets of paper; a staple receiving portion attached on the staple striking portion and configured to receive the staple before being struck out from the staple striking portion; a binding portion for binding the sheets of paper by bending staple legs of the staple penetrating the sheets of paper, and a paper clamping portion for clamping the sheets of paper between the staple striking portion and the binding portion; wherein the staple receiving portion includes a clamping portion exposed to the paper clamping portion and configured to clamp the sheets of paper, and a staple guide portion provided on an end portion of the clamping portion at a side thereof, on which the staple striking portion is located, and configured to guide the staple struck by the staple striking portion; wherein the clamping portion is configured of a resin material; wherein the staple guide portion includes a staple leg support member provided on a side of the clamping portion opposite to a side thereof, on which the sheets of paper are clamped, and configured to support the staple legs of the staple struck by the staple striking portion, and a guide member provided to oppose the staple leg support member; wherein the staple leg support member and the guide member are configured of a metal material.

Also, the present invention is a stapler suitable for a post-processing device having a stapler for binding sheets of paper with a staple and configured to perform a post-processing on sheets of paper with an image formed thereon, wherein the stapler includes a staple striking portion for striking a staple to penetrate sheets of paper; a staple receiving portion attached on the staple striking portion and configured to receive the staple before being struck out from the staple striking portion; a binding portion for binding the sheets of paper by bending staple legs of the staple penetrating the sheets of paper; and a paper clamping portion for clamping the sheets of paper between the staple striking portion and the binding portion; wherein the staple receiving portion includes a clamping portion exposed to the paper clamping portion and configured to clamp the sheets of paper, and a staple guide portion provided on an end portion of the clamping portion at a side thereof, on which the staple striking portion is located, and configured to guide the staple struck by the staple striking portion; wherein the clamping portion is configured of a resin material; wherein the staple guide portion includes a staple leg support member provided on a side of the clamping portion opposite to a side thereof, on which the sheets of paper are clamped, and configured to support the staple legs of the staple struck by the staple striking portion, and a guide member provided to oppose the staple leg support member; wherein the staple leg support member and the guide member are configured of a metal material.

Further, the present invention is a stapler suitable for an image formation system including an image formation device configured to form an image on a sheet of paper and then to output the sheet of paper, and the post-processing device as described above connected to the image formation device and configured to perform a post-processing on the sheets of paper.

According to the present invention, the staple legs of the staple struck out from the staple striking portion are guided by the staple leg support member and the guide member, which both are configured of a metal material. The staple leg support member is provided on a side of the clamping portion, which is configured to clamp sheets of paper at the paper clamping portion, opposite to a surface thereof, which comes in contact with the sheets of paper, and as a result, the staple leg support member is not exposed on the surface of the clamping portion.

According to the present invention, since the staple leg support member is not exposed on the surface of the clamping portion, it is possible to inhibit the sheets of paper to be caught during an operation of inserting the sheets of paper into the paper clamping portion, thereby inhibiting occurrence of a poor insertion of the sheets of paper.

Also, the staple legs of the staple passing by the end portion of the clamping portion configured of a resin material and struck out from the staple receiving portion are guided by the staple leg support member and the guide member, which both are configured of a metal material, on the side of the clamping portion opposite to the surface thereof, which comes in contact with the sheets of paper. Therefore, it is possible to inhibit occurrence of buckling of the staple legs.

DETAILED DESCRIPTION

Hereinafter, embodiments of a stapler according to the present invention, a post-processing device having the stapler and an image formation system having the post-processing device will be described with reference to the accompanying drawings.

<Exemplary Configuration of Stapler of the Present Embodiment>

Figure 1:
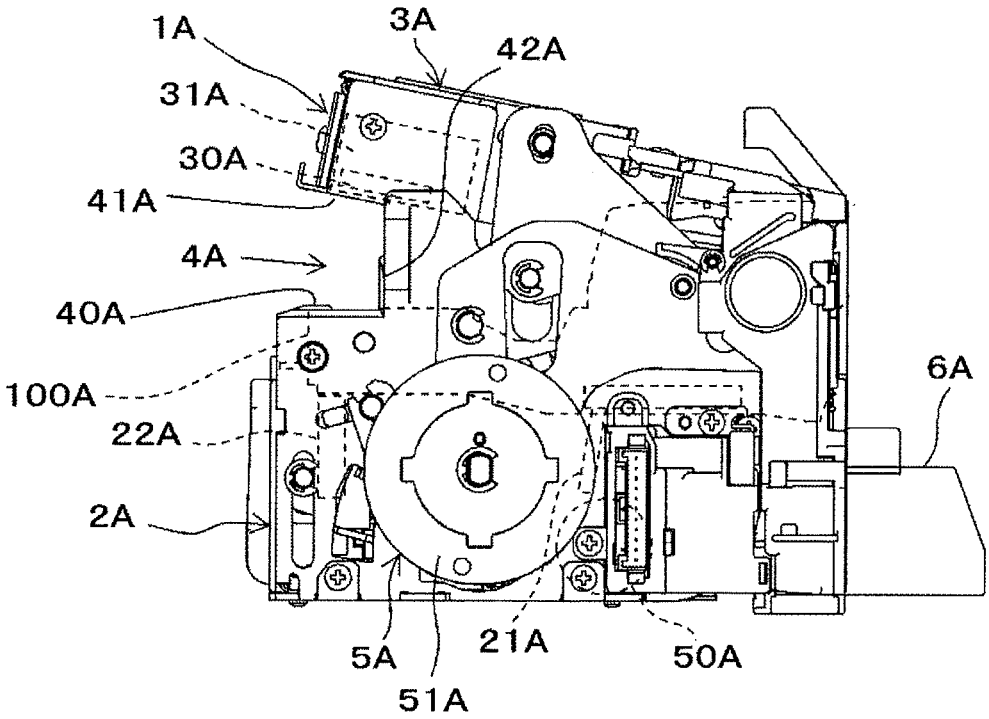
FIG. 1 is a side view showing one example of a stapler of the present embodiment.
Figure 2:
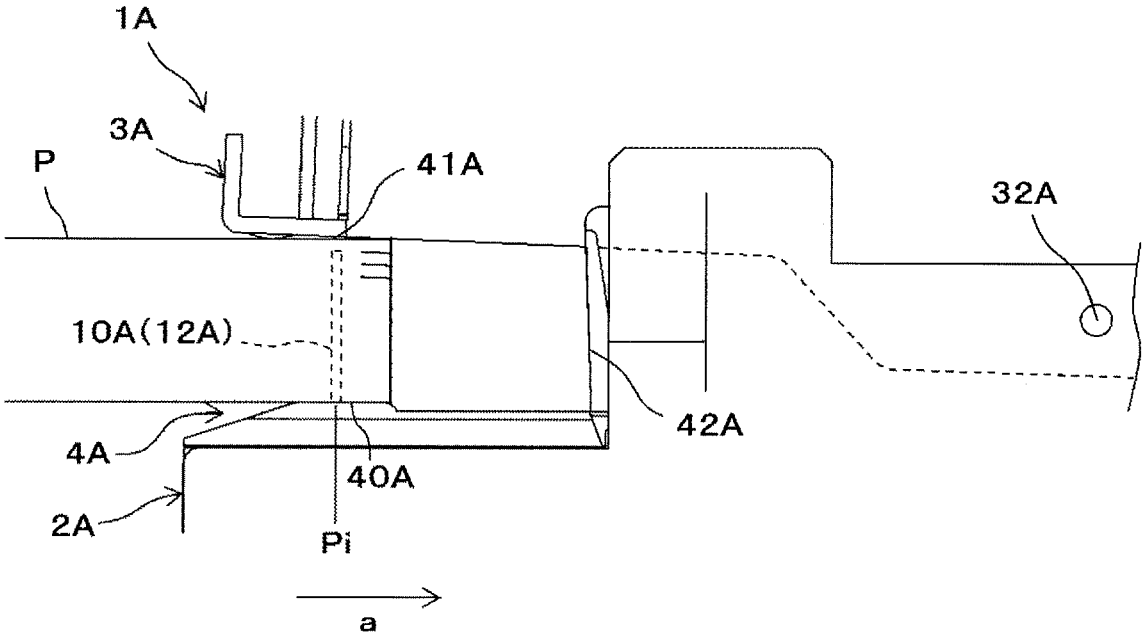
FIG. 2 is a side view showing a main part of the example of the stapler of the present embodiment.
Figure 3A:
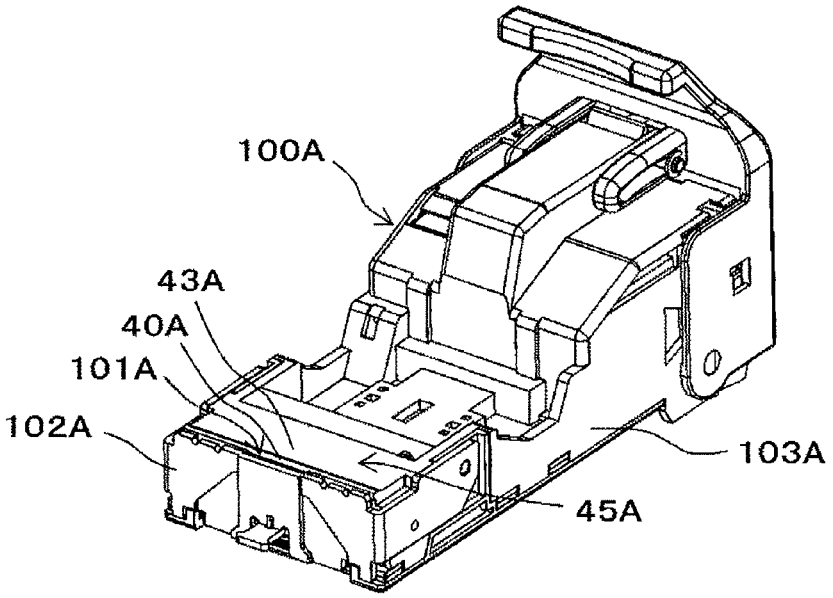
FIGS. 3A and 3B are perspective views showing one example of a staple cartridge of the present embodiment to be attached on the stapler.
Figure 3B:
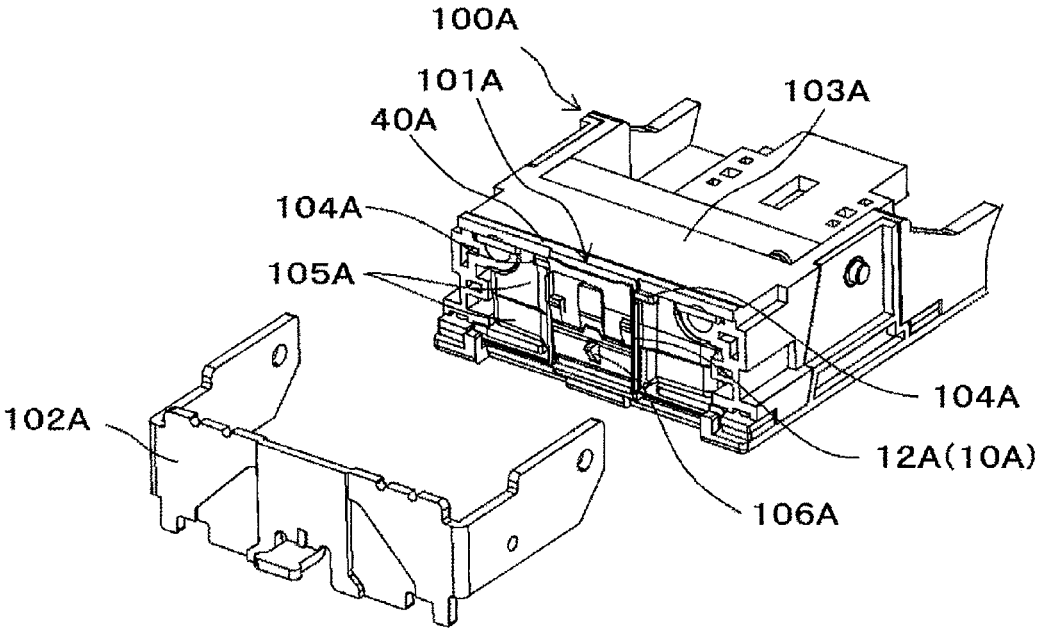

FIG. 1 is a side view showing one example of a stapler of the present embodiment, and FIG. 2 is a side view showing a main part of the example of the stapler of the present embodiment. Also, FIGS. 3A and 3B are perspective views showing one example of a staple cartridge of the present embodiment to be attached on the stapler, in which FIG. 3A is a perspective view of the entire staple cartridge of the present embodiment and FIG. 3B is an exploded perspective view of a main part of the staple cartridge of the present embodiment. Further, FIGS. 4A to 4D are an explanatory view showing one example of an operation of binding sheets of paper with a staple.

Figure 4A:
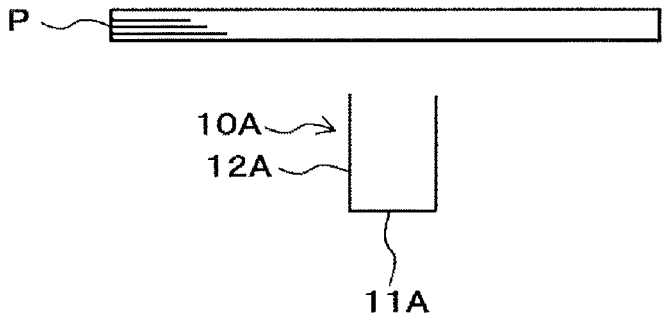
FIGS. 4A to 4D are explanatory views showing one example of an operation of binding sheets of paper with a staple.

First, an operation of binding sheets of paper P with a stapler 1A will be described with reference to FIG. 4. As shown in FIG. 4A, a staple 10A has staple legs 12A formed by bending both ends of a staple crown 11A toward one direction. That is, the staple 10A is shaped in a generally U-shape.

Figure 4B:
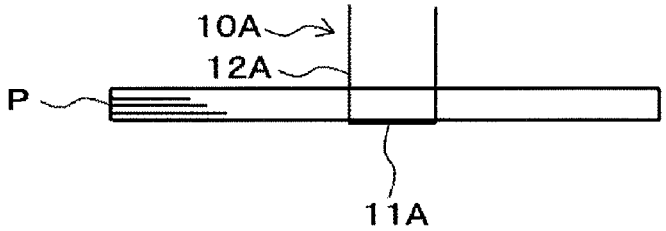
Figure 4C:
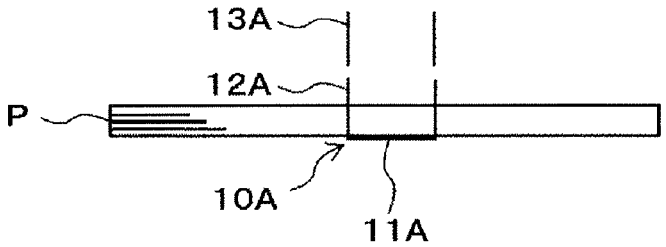

As shown in FIG. 4B, the staple 10A is configured such that as the staple crown 11A is pressed, the staple legs 12A penetrate sheets of paper P and then the staple crown 11A comes in contact with the sheets of paper P. In the staple 10A of which the staple legs 12A have penetrated the sheets of paper P, as shown in FIG. 4C, surplus parts of the staple legs 12A which are to overlap with each other when the staple legs 12A are bent are cut as cut staples 13A.

Figure 4D:
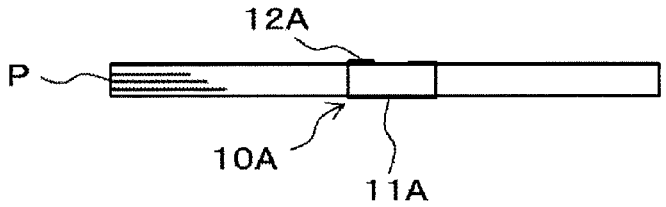

In the staple 10A of which the staple legs 12A have been cut into a predetermined length, as shown in FIG. 4D, the staple legs 12A penetrating the sheets of paper P are bent and thus the sheets of paper P are bound with the staple 10A.

Next, a configuration of the stapler 1A of the present embodiment will be described with reference to the figures. The stapler 1A includes a staple striking unit 2A for supplying and striking a staple 10A, and a binding unit 3A for binding sheets of paper P with the staple 10A by cutting and bending staple legs 12A of the staple 10A in cooperation with the staple striking unit 2A. Also, the stapler 1A has a paper clamping portion 4A for clamping a bundle of sheets of paper P between the staple striking unit 2A and the binding unit 3A.

In the following description, a side on which the paper clamping portion 4A is provided is referred to as a front side of the stapler 1A, and a side opposite to the side on which the paper clamping portion 4A is provided is referred to as a rear side thereof. Also, a side on which the binding unit 3A is provided is referred to as an upper side of the stapler 1A, and a side on which the staple striking unit 2A is provided is referred to as a lower side of the stapler 1A.

The staple striking unit 2A is an example of a staple striking portion and is configured such that a staple cartridge 100A, which is a staple receiving portion in which staples 10A are received, is removably attached thereon. The staple striking unit 2A has a feeding portion 21A for feeding a staple 10A from the staple cartridge 100A and a striking portion 22A for driving the staple 10A into sheets of paper P.

In the present example, staples 10A are provided as a staple sheet, in which a plurality of linear staples 10A are integrated by adhesion, and a plurality of staple sheets are stacked and received in the staple cartridge 100A. The striking portion 22A is configured to strike one staple 10A of the staple sheet, which is located at the most leading end in a conveying direction thereof, and at the same time to shape a second, and possibly a third, staple 10A into a generally U-shape as shown in FIG. 4A and the like.

The binding unit 3A is an example of a binding portion and has a cutting portion 30A for cutting staple legs 12A of the staple 10A, which have penetrated sheets of paper P, into a predetermined length, and a clincher portion 31A for bending the staple legs 12A of the staple 10A, which have penetrated the sheets of paper P and have been cut into the predetermined length, toward the sheets of paper P.

The paper clamping portion 4A has a shape, which is opened on front, right and left sides of the stapler 1A, so that a binding location Pi on the sheets of paper P at which the sheets of paper P are bound with the staple 10A can be positioned between the striking portion 22A and the clincher portion 31A.

The paper clamping portion 4A has a first clamping portion 40A provided on the staple striking unit 2A and a second clamping portion 41A provided on the binding unit 3A to oppose the first clamping portion 40A. The stapler 1A is configured to clamp sheets of paper P between the fast clamping portion 40A and the second clamping portion 41A as the binding unit 3A is moved in a direction approaching the staple striking unit 2A by rotationally operating the binding unit 3A about an axis 32A.

The paper clamping portion 4A has a paper position restriction portion 42A for restricting a position of the sheets of paper Pin an insertion direction thereof as shown by an arrow a. The paper position restriction portion 42A protrudes between the first clamping portion 40A and the second clamping portion 41A at an inner side of the paper clamping portion 4A with respect to the insertion direction of the sheets of paper P as shown by the arrow a. Therefore, the sheets of paper P inserted into the paper clamping portion 4A are restricted from being inserted more inward than the paper position restriction portion 42A.

The staple cartridge 100A is an example of a staple receiving portion and is configured such that a staple guide portion 101A for guiding a staple 10A struck by the striking portion 22A shown in FIG. 1 is provided on a distal end side thereof in a conveying direction of the staple sheet (not shown) as shown in FIG. 3A. The staple cartridge 100A is configured such that a guide member 102A covering a front side of the staple guide portion 101A is attached to a case 103A to be openable and closable. In the staple cartridge 100A, the case 103A is configured of a resin material and the guide member 102A is configured of a metal material. When the staple cartridge 100A is attached to the staple striking unit 2A, the staple guide portion 101A, the guide member 102A on the front side of the staple guide portion 101A and the case 103A on a rear side thereof are exposed to the paper clamping portion 4A to oppose the second clamping portion 41A.

The stapler 1A is configured such that the first clamping portion 40A is defined by a part of the case 103A exposed to the paper clamping portion 4A. The first clamping portion 40A is an example of a clamping portion and is configured such that a predetermined-shaped surface thereof extending between the staple guide portion 101A and the paper position restriction portion 42A over a width direction of the staple cartridge 100A is provided by the case 103A of the staple cartridge 100A. The staple guide portion 101A is provided on a front end of the first clamping portion 40A and is exposed to sheets of paper P.

As shown in FIG. 3B, the staple cartridge 100A has a staple leg support member 104A, pusher 105A and a pressed portion 106A. The staple leg support member 104A is configured to support staple legs 12A of a staple 10A passing through the staple guide portion 101A. The pusher 105A is configured to press the staple 10A against the guide member 102A. The pressed portion 106A is configured to operate a delivering claw (not shown) in conjunction with striking of the staple 10A.

The staple leg support member 104A is configured of a metal material and is provided on a lower side of the first clamping portion 40A, which is configured by the case 103A configured of a resin material, opposite to a side thereof on which sheets of paper P are clamped. The staple leg support member 104A is configured to oppose the guide member 102A and thus to be exposed to a path, through which the staple legs 12A of the staple 10A pass, at a front surface of the case 103A. The staple leg support member 104A is provided to be movable in directions narrowing and widening a distance between the staple leg support member 104A and the guide member 102A and is urged in a direction approaching the guide member 102A by an urging member such as a spring (not shown). In a state where the staple legs 12A of the staple 10A are not positioned in the path through which the staple legs 12A pass, the staple leg support member 104A is configured such that a part thereof which does not support the staple legs 12A abuts against the guide member 102A. At this time, a gap defining the path through which the staple legs 12A pass is formed between a part of the staple leg support portion 104A, which supports the staple legs 12A, and the guide member 102A. As a result, the part of the staple leg support portion 104A, which supports the staple legs 12A does not abut against the guide member 102A.

The pusher 105A is configured of a resin material and is configured to oppose the guide member 102A and thus to be exposed to a path, through which the staple 10A passes, at the front surface of the case 103A. The pusher 105A is provided to be movable in directions narrowing and widening a distance between the pusher 105A and the guide member 102A and is urged in a direction approaching the guide member 102A by an urging member such as a spring (not shown). In a state where the staple 10A is not positioned in the path through which the staple 10A passes, the pusher 105A is configured such that a part of a front surface of the pusher 105A abuts against the guide member 102A.

The pressed portion 106A is provided as a member for operation the delivering claw (not shown) configured to deliver the staple sheet and is configured to oppose the guide member 102A and thus to be exposed to a path, through which the staple crown 11A of the staple 10A passes, at the front surface of the case 103A. The pressed portion 106A is urged in a direction approaching the guide member 102A by an urging member such as a spring (not shown). In a state where the staple crown 11A of the staple 10A is not positioned in the path through which the staple crown 11A passes, the pressed portion 106A is configured such that a distal end of the pressed portion 106A abuts against the guide member 102A.

The stapler 1A has a drive unit 5A. The drive unit 5A opens and closes the staple striking unit 2A and the binding unit 3A relative to each other. The drive unit 5A drives the feeding portion 21A and the striking portion 22A of the staple striking unit 2A and the cutting portion 30A and the clincher portion 31A of the binding unit 3A.

The drive unit 5A has a cam 51A driven by a motor 50A provided in the staple striking unit 2A, linkages (not shown) for transferring an operation of the cam 51A to each part, and the like.

According to the stapler 1A, as an operation of the cam 51A is transferred to the binding unit 3A via linkages and the like, the staple striking unit 2A and the binding unit 3A are moved relative to each other in separating/contacting directions, in which they separate from and contact with each other. In the present example, the binding unit 3A is moved relative to the staple striking unit 2A in the separating/contacting directions by a rotating operation thereof about the axis 32A.

According to the stapler 1A, the binding unit 3A is moved in a direction approaching the staple striking unit 2A by an operation, in which the cam 51A rotates in one direction, and thus the paper clamping portion 4A clamps sheets of paper P at a predetermined timing. Also, according to the stapler 1A, the binding unit 3A is moved in a direction separating from the staple striking unit 2A at a predetermined timing by an operation, in which the cam 51A further rotates in one direction, and thus clamping of the sheets of paper P by the paper clamping portion 4A is released.

Further, according to the stapler 1A, an operation of the cam 51A is transferred to the feeding portion 21A and the striking portion 22A via linkages and the like. Therefore, due to an operation in which the cam 51A rotates in one direction, staples 10A received in the staple cartridge 100A are fed by the feeding portion 21A, and then one of the fed staples 10A, which is located at the most leading end thereof, is driven into sheets of paper P, which are clamped by the paper claiming portion 4A, by the striking portion 22A. As a result, staple legs 12A of the staple 10A penetrate the sheets of paper P. Also, a second, and possibly a third, staple 10A is shaped into a generally U-shape as shown in FIG. 4A and the like.

Further, according to the stapler 1A, an operation of the cam 51A is also transferred to the cutting portion 30A and the clincher portion 31A via linkages and the like. Therefore, due to an operation in which the cam 51A rotates in one direction, the staple legs 12A of the staple 10A penetrating the sheets of paper P are cut into a predetermined length by the cutting portion 30A, and then the staple legs 12A of the staple 10A, which have been cut into predetermined length, are bent by the clincher portion 31A.

The stapler 1A has a cut staple receiving portion 6A for receiving cut staples 13A cut by the cutting portion 30A. The cut staple receiving portion 6A is removably attached on the stapler 1A on a rear side of the stapler 1A opposite to a side thereof, on which the paper clamping portion 4A is provided.

<Exemplary Configuration of Image Formation System and Post-processing Device>

Figure 5:
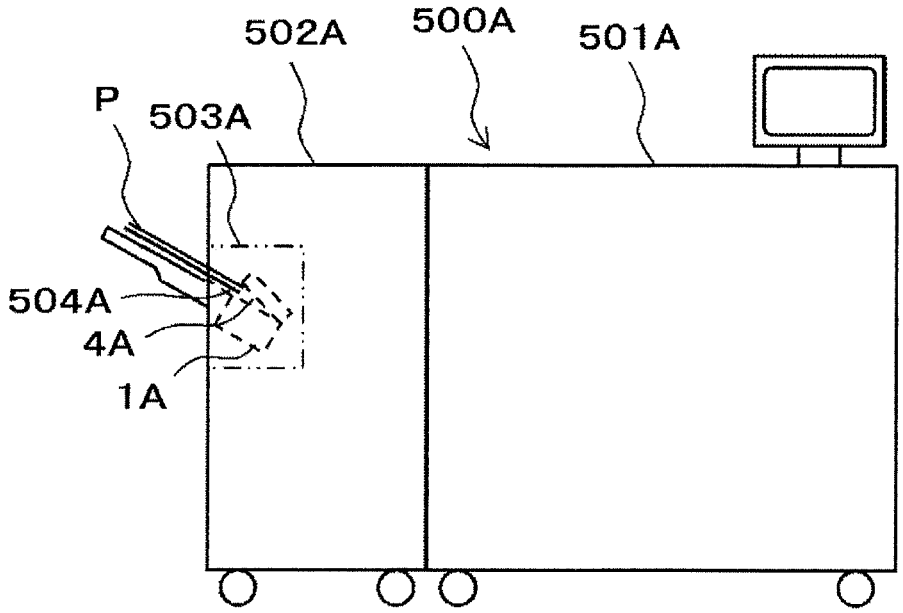
FIG. 5 is a configuration view showing an outline of an image formation system of the present embodiment.
Figure 6:
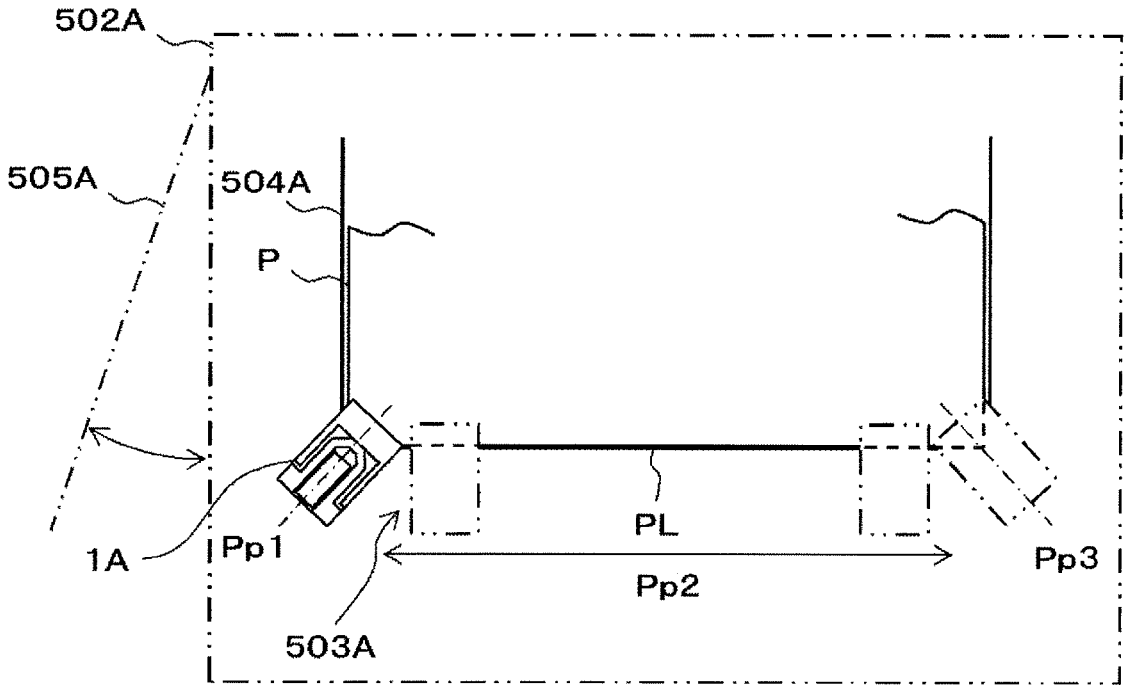
FIG. 6 is a configuration view showing one example of a post-processing device of the present embodiment.

FIG. 5 is a configuration diagram showing an outline of an image formation system of the present embodiment, and FIG. 6 is a configuration diagram showing one example of a post-processing device of the present embodiment.

The image formation system 500A of the present embodiment has an image formation device 501A and a post-processing device 502A capable of performing at least one kind of processing. The image formation device 501A is configured to form an image on a sheet of paper P fed from a paper feeding portion (not shown), which is provided inside or outside the device, and then to output the sheet of paper P. In the present example, the image formation device 501A is configured to form an image on the sheet of paper P by forming an electrostatic latent image by scanning exposure, developing the electrostatic latent image by a toner, and then transferring and fixing the toner onto the sheet of paper.

The post-processing device 502A of the present embodiment has the stapler 1A on a binding portion 503A thereof. The binding portion 503A has a stacking portion 504A in which sheets of paper P outputted from the image formation device 501A are stacked.

FIG. 6 is a view of the binding portion 503A of the post-processing device 502A as viewed from above. As shown in FIG. 6, the stapler 1A is configured to be moved to a first position Pp1 where the sheets of paper P stacked in the stacking portion 504A are bound at one corner, a second position Pp2 where the sheets of paper P are bound at any location along a side PL thereof, and a third position Pp3 where the sheets of paper P are bound at another corner, by a moving unit (not shown). In the present example, the first position Pp1 also serves as a reference position, which is a home position (HP). In the present example, attaching and detaching of the cut staple receiving portion 6A is performed by moving the stapler 1A to the first position Pp1 and then opening a door 505A.

<Exemplary Operation and Effects of Stapler of the Present Embodiment>

Figure 7:
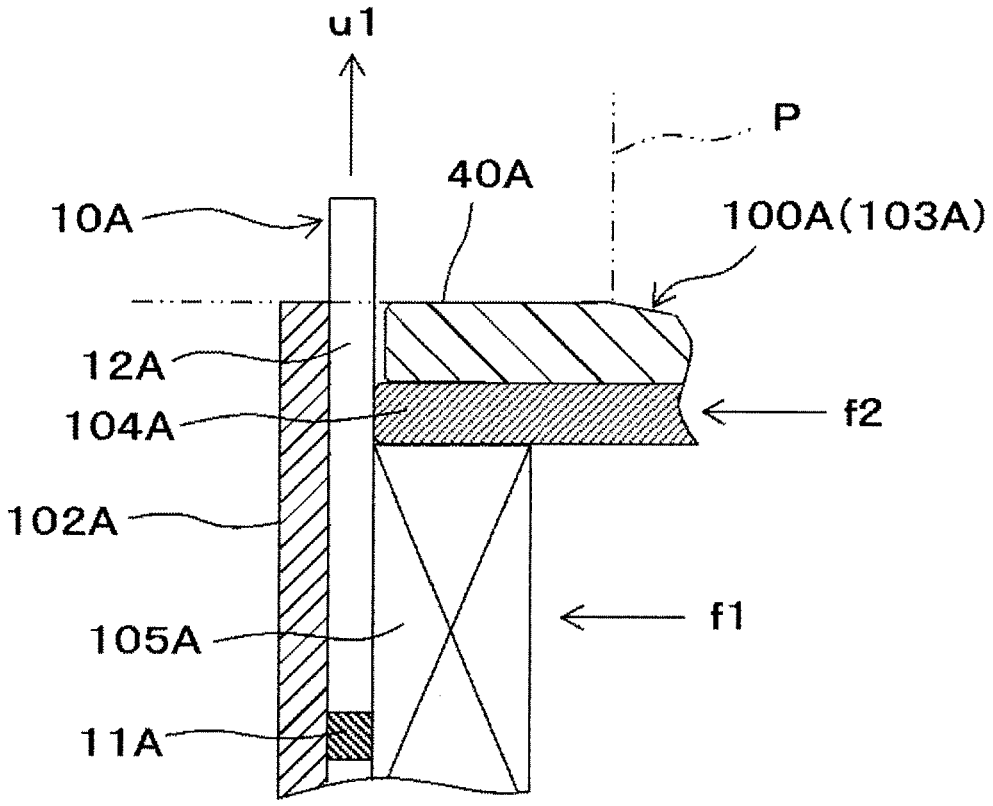
FIG. 7 is an explanatory view showing one example of an operation of binding sheets of paper with the stapler of the present embodiment.

FIG. 7 is an explanatory view showing one example of an operation of binding sheets of paper with the stapler of the present embodiment, and hereinafter, the operation of the stapler of the present embodiment will be described with reference to each of the figures.

During an operation of binding sheets of paper P with the stapler 1A, one staple 1A is shaped, separated and then struck out from a staple sheet (not shown) by the striking portion 22A of the staple striking unit 2A as shown in FIG. 1. In the staple guide portion 101A, as staple legs 12A of the one separated staple 1A are struck in a direction of an arrow u1, the staple legs 12A enter between the pusher 105A and the guide member 102A. Then, the pusher 105A is pushed and retracted by the staple legs 12A and thus a gap corresponding to a thickness of one staple 10A is formed between the pusher 105A and the guide member 102A.

Therefore, the staple crown 11A and the staple legs 12A of the staple 10A pass between the pusher 105A and the guide member 102A while being pressed against the guide member 102A by the pusher 105A urged in a direction of an arrow f1. Thus, the staple 10A is prevented from being struck out from the staple cartridge 100A while being inclined with respect to a surface of the sheets of paper P clamped by the paper clamping portion 4A.

Also, in the staple guide portion 101A, as the staple legs 12A of the one separated staple 1A are struck in the direction of the arrow u1, the staple legs 12A enter a gap between the staple leg support member 104A and the guide member 102A, which is formed as a path through which the staple legs 12A pass. Therefore, the staple legs 12A of the staple 10A pass between the staple leg support member 104A and the guide member 102A while being supported by the staple leg support portion 104A and the guide member 102A.

In the staple guide portion 101A, the staple legs 12A of the staple 10A pass between the guide member 102A configured of a metal material and the first clamping portion 40A configured of a resin material at a part thereof close to the sheets of paper P. But, since the staple leg support member 104A configured of a metal material is provided below the first clamping portion 40A, the staple legs 12A are supported by the staple leg support portion 104A and the guide member 102A.

Therefore, during an operation of forcing the staple legs 12A of the staple 10A to penetrate the sheets of paper P clamped by the paper clamping portion 4A, it is possible to inhibit occurrence of a phenomenon referred to as buckling, in which the staple legs 12A are bent by a penetration resistance when the staple legs 12A penetrate the sheets of paper P and a driving force of driving the staple 10A into the sheets of paper P.

Further, in the staple guide portion 101A, as the staple crown 11A of the one separated staple 1A is struck in the direction of the arrow u1, the staple crown 11A enters between the pressed portion 106A and the guide member 102A. Then, the pressed portion 106A is pushed and retracted by the staple crown 11A. After the staple crown 11A passes by the pressed portion 106A, the member provided on the staple striking unit 2A for striking the staple 10A is retracted and then the pressed portion 106A is moved forward. Due to this operation of the pressed portion 106A, the delivering claw (not shown) is reciprocatingly moved and thus a staple sheet received in the staple cartridge 100A is delivered.

In conventional staplers, a staple leg support member is exposed on a clamping portion configured by a case of a staple cartridge. Since the case of the staple cartridge and the staple leg support member are separate components, a groove, a step and the like formed at a boundary between the clamping portion and the staple leg support member are exposed on a surface of the clamping portion. Therefore, there is a possibility that during an operation of inserting sheets of paper into the paper clamping portion, the sheets of paper are caught and thus a poor insertion of the sheets of paper is occurred.

In contrast, according to the staple 1A of the present embodiment, the stapler leg support member 104A is provided below the first clamping portion 40A formed by the case 103A of the staple cartridge 100A, thereby preventing the staple leg support member 104A from being exposed on the surface of the first clamping portion 40A. Therefore, no groove and the like, which would otherwise cause the sheets of paper P to be caught therein, are formed on the first clamping portion 40A. As a result, during an operation of inserting the sheets of paper P into the paper clamping portion 4A, the sheets of paper P is prevented from being caught on the way, thereby inhibiting occurrence of a poor insertion of the sheets of paper P.

Herein, the case 103A of the staple cartridge 100A has a thickness of about 1 mm to 3 mm at a part thereof forming the first clamping portion 40A. On the other hand, a length of the staple legs 12A of the staple 10A is about 10 mm to 15 mm, and thus the thickness of the first clamping portion 40A is sufficiently thin relative to the length of the staple legs 12A. Therefore, even if the first clamping portion 40A which does not support the staple legs 12A is present between the sheets of paper P, which are clamped by the first clamping portion 40A, and the staple leg support member 104A, occurrence of buckling of the staple legs 12A can be sufficiently inhibited.

<Variants of Stapler of the Present Embodiment>

In the stapler 1A of the present embodiment, the staple leg support member 104A is configured to be movable and to be urged toward the guide member 102A. However, the staple leg support member 104A may be configured to be stationary in a state where a gap corresponding to a thickness of one staple 10A and allowing one staple 10A to pass therethrough is formed between the staple leg support member 104A and the guide member 102A.

1A Stapler
10A Staple
12A Staple leg
2A Staple striking unit
21A Feeding portion
22A Striking portion
3A Binding unit
30A Cutting portion
31A Clincher portion
32A Shaft
4A Paper clamping portion
40A First clamping portion
41A Second clamping portion
42A Paper position restriction portion
5A Drive unit
6A Cut staple receiving portion
100A Staple cartridge
101A Staple guide portion
102A Guide member
103A Case
104A Staple leg support member
105A Pusher
106A Pressed member

The invention claimed is:

1. A stapler, comprising:

a staple striking portion configured to strike a staple so as to penetrate sheets of paper;

a staple receiving portion attached on the staple striking portion and configured to receive the staple before being struck out from the staple striking portion;

a binding portion configured to bind the sheets of paper by bending staple legs of the staple penetrating the sheets of paper; and a paper clamping portion configured to clamp the sheets of paper between the staple striking portion and the binding portion, wherein the staple receiving portion comprises:

a clamping portion exposed to the paper clamping portion and configured to clamp the sheets of paper; and a staple guide portion provided on an end portion of the clamping portion at a side thereof on which the staple striking portion is located, and configured to guide the staple struck by the staple striking portion, wherein the clamping portion is configured of a resin material, wherein the staple guide portion comprises:

a staple leg support member provided on a side of the clamping portion opposite to a side thereof on which the sheets of paper are clamped, and configured to support the staple legs of the staple struck by the staple striking portion; and a guide member provided to oppose the staple leg support member, and wherein the staple leg support member and the guide member are configured of a metal material.

2. The stapler according to claim 1, wherein the staple leg guide member is provided to be movable in directions approaching and separating from the guide member and is urged in the direction approaching the guide member.

3. The stapler according to claim 1, wherein the staple leg guide member is configured to be stationary in a state where a gap allowing one staple to pass therethrough is formed between the staple leg guide member and the guide member.

* * * * *